US008225707B2

(12) United States Patent
Heilig

(10) Patent No.: US 8,225,707 B2
(45) Date of Patent: Jul. 24, 2012

(54) HYDRAULIC RADIAL PISTON ENGINE

(75) Inventor: Eduard Heilig, Friedrichshafen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 479 days.

(21) Appl. No.: 12/517,816

(22) PCT Filed: Dec. 3, 2007

(86) PCT No.: PCT/EP2007/063111

§ 371 (c)(1),
(2), (4) Date: Jun. 5, 2009

(87) PCT Pub. No.: WO2008/068206

PCT Pub. Date: Jun. 12, 2008

(65) Prior Publication Data

US 2010/0154743 A1 Jun. 24, 2010

(30) Foreign Application Priority Data

Dec. 7, 2006 (DE) ..... 10 2006 058 076

(51) Int. Cl.
*F01B 1/06* (2006.01)
*F01B 13/06* (2006.01)
*F01B 29/00* (2006.01)

(52) U.S. Cl. ..... 91/491; 92/128

(58) Field of Classification Search ..... 91/491–498; 92/72, 128

See application file for complete search history.

(56) References Cited

U.S. PATENT DOCUMENTS

| | | | | | |
|---|---|---|---|---|---|
| 3,080,152 | A | * | 3/1963 | Lendved | 366/44 |
| 3,225,701 | A | * | 12/1965 | Griffith | 91/488 |
| 3,760,691 | A | * | 9/1973 | Kleckner et al. | 91/492 |
| 3,921,962 | A | * | 11/1975 | Feger et al. | 366/64 |
| 4,136,602 | A | | 1/1979 | Lenz | |
| 4,207,804 | A | * | 6/1980 | Fukui | 91/499 |
| 4,484,870 | A | * | 11/1984 | Erasov | 418/61.3 |
| 4,522,110 | A | * | 6/1985 | Samuelsson | 91/488 |
| 4,704,948 | A | * | 11/1987 | Wusthof et al. | 92/58 |
| 4,719,843 | A | * | 1/1988 | Noel | 92/58 |
| 4,747,339 | A | | 5/1988 | Wusthof et al. | |
| 4,898,076 | A | * | 2/1990 | Bigo et al. | 91/491 |
| 4,953,524 | A | * | 9/1990 | Wusthof et al. | 91/491 |
| 5,090,295 | A | * | 2/1992 | Cunningham et al. | 91/491 |
| 5,179,889 | A | * | 1/1993 | Wusthof et al. | 91/491 |
| 5,439,356 | A | * | 8/1995 | Grahl | 417/273 |

(Continued)

FOREIGN PATENT DOCUMENTS

| | | |
|---|---|---|
| DE | 3431158 | 3/1986 |
| DE | 102004057849 | 6/2006 |
| EP | 1355068 | 10/2003 |
| FR | 2576363 | 7/1986 |
| GB | 1253993 | 11/1971 |
| GB | 2163493 | 2/1986 |
| WO | 9210676 | 6/1992 |

*Primary Examiner* — Devon Kramer
*Assistant Examiner* — Christopher Maxey
(74) *Attorney, Agent, or Firm* — Davis & Bujold, P.L.L.C.

(57) ABSTRACT

To avoid having to strip down a radial piston engine (1) into its individual components when it is disassembled, a rotary cylinder (5) has a collar (19) on which the rotary cylinder is supported against the cam disk (2), the cam disk (2) being rotationally fixed in position to a housing portion (13).

13 Claims, 4 Drawing Sheets

Figure 1:
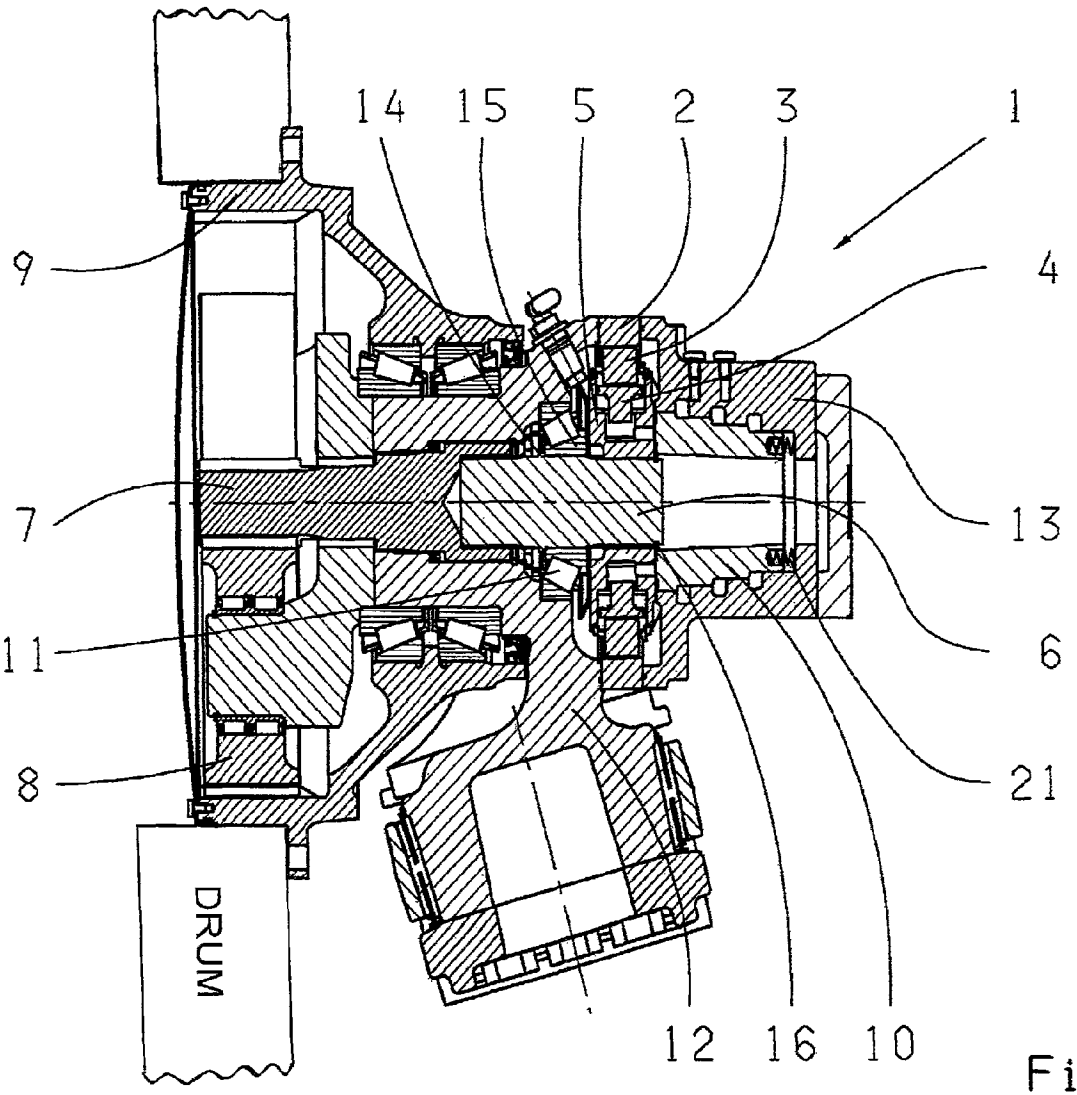

U.S. PATENT DOCUMENTS 5,746,509 A * 5/1998 Gebhard et al. ..... 366/61
5,820,506 A * 10/1998 Mann ..... 475/83
5,836,231 A * 11/1998 Leinonen ..... 91/491
6,074,083 A * 6/2000 Gebhard et al. ..... 366/61
6,186,262 B1 * 2/2001 Mann et al. ..... 180/308
6,293,100 B1 * 9/2001 Allart et al. ..... 60/442
6,607,049 B2 * 8/2003 Cigal ..... 180/305
6,978,713 B2 * 12/2005 Allart et al. ..... 92/72
7,185,579 B2 * 3/2007 Allart et al. ..... 92/72
7,225,721 B2 * 6/2007 Lemaire ..... 92/72
7,878,699 B2 * 2/2011 Schiffner et al. ..... 366/62
2008/0256939 A1 * 10/2008 Lemaire et al. ..... 60/420

* cited by examiner

HYDRAULIC RADIAL PISTON ENGINE

This application is a National Stage completion of PCT/EP2007/063111 filed Dec. 8, 2007 which claims priority from German patent application No. 10 2006 058 076.1 file Dec. 7, 2006.

The invention relates to a hydraulic radial piston engine

BACKGROUND OF THE INVENTION

Hydraulic radial piston engines are used for example for driving a transmission of a concrete mixer on a truck, as disclosed in DE 10 2004 057 849 A1. In such cases a housing portion, in which a distributor is arranged, is bolted to a further housing portion, with a cam disk arranged between the two housing portions. A rotary cylinder, which in operation turns about a rotational axis, has radially positioned pistons which are in active connection with the cam disk and, in the operating condition, is supported by a bearing on the further housing portion. For servicing purposes the bolts which fix the housing portion and the rotary cylinder to the further housing portion are removed, and the hydraulic radial piston engine is dismantled from the concrete mixer truck in individual components. The complete assembly cannot be exchanged as a whole because when the bolts are removed, the hydraulic engine is no longer held together.

FR 2 576 363 discloses a hydraulic radial piston engine in which the housing portion with the rotary cylinder and the further housing portion are connected as a structural unit to the rest of the transmission by bolts. This arrangement requires an additional housing plate between the transmission housing and the hydraulic engine, but this considerably increases the overall axial length.

SUMMARY OF THE INVENTION

The purpose of the present invention is to provide a hydraulic engine which, for servicing purposes, can be exchanged as a structural unit, without increasing the overall axial length.

This objective is achieved with a hydraulic radial piston engine of the type concerned.

The hydraulic radial piston engine comprises a housing portion in which there is a hydraulic distributor and which is connected to the cam disk by connection means. The rotary cylinder has pistons arranged radially, which are connected to the cam disk. The cam disk is connected in a rotationally and positionally fixed manner to the housing portion by connection means, this connection remaining in place even in the dismantled condition. In the dismantled condition the rotary cylinder is supported along its rotation axis, in the direction opposite to that in which it is connected to the hydraulic distributor, on the cam disk. To enable this the rotary cylinder can comprise, on the side facing toward the distributor, a collar whose diameter is larger than the inside diameter of the cam disk, so that the collar can be brought to bear at least partially against the cam disk.

In another embodiment the rotary cylinder can have, on the side facing toward the oil distributor, a groove into which a ring can be inserted, which can rest on one side against the rotary cylinder and on the other side against the cam disk. The hydraulic distributor has springs by which it is pushed toward the rotary cylinder. For servicing purposes, when the hydraulic radial piston engine is separated from the further housing portion the springs press the distributor against the rotary cylinder and the rotary cylinder is supported on the cam disk.

Since the cam disk is connected to the housing portion, the hydraulic radial piston engine stays together as a structural unit.

In a further embodiment this structural unit can additionally comprise a driveshaft on which the inner ring of a bearing is arranged, the driveshaft being formed in such manner that, at least in the axial direction, the inner ring of the bearing is held on the driveshaft while the driveshaft itself is held positionally fixed in the hydraulic radial piston engine. For that purpose the driveshaft can have a groove with a retaining ring which is supported on the surface upon which the distributor rests against the rotary cylinder, or else the driveshaft can have a collar which, as in the case of the retaining ring just described, is supported on the surface of the rotary cylinder.

In another embodiment of the invention, the driveshaft can have a rod which passes through the housing portion in which the distributor is arranged, so that at least in the axial direction the driveshaft is supported on the housing portion. The rod can be made integrally with the driveshaft, but can also be in the form of a screw which is screwed into the driveshaft in order to hold the driveshaft, the inner ring of the bearing and the rotary cylinder in the direction of the distributor. For this purpose the housing portion in which the distributor is arranged or a housing portion connected thereto has a perforation through which the rod or screw passes through the housing portion concerned, to be connected to the driveshaft. The rod or screw is supported against the housing portion by a widened section. In one design form the screw can be removed in the assembled condition of the radial piston engine.

Thus, for servicing purposes the radial piston engine can be separated from the rest of the housing without having to be stripped down to its individual components.

BRIEF DESCRIPTION OF THE INVENTION

Other features emerge from the description of the figures, which show:

FIG. 1: Drive transmission for the drum of a concrete mixer truck with a hydraulic radial piston engine FIG. 2: Section of the radial piston engine, with the rotary cylinder supported on the cam disk FIG. 3: Radial piston engine with a driveshaft held by a bolt, and FIG. 4: Radial piston engine with a driveshaft held by a rod.

DETAILED DESCRIPTION OF THE INVENTION

FIG. 1: A hydraulic radial piston engine 1 comprises a cam disk 2 which is in active connection with a rotary cylinder 5 via rollers 3 and pistons 4, and the rotary cylinder 5 is connected in a rotationally fixed manner to a driveshaft 6, and the driveshaft 6 is connected in a rotationally fixed manner to a sun gear 7. Via planetary gears 8, the sun gear 7 drives a ring gear 9 by which a drum (only diagrammatically shown as element DRUM) of a concrete mixer truck is rotationally driven. The axial force from the distributor 10 upon the rotary cylinder 5 is transmitted by a bearing 11 to a further housing portion 12, which directly forms the housing of the step-down transmission and the supporting base. A housing portion 13 accommodates the distributor 10 and is connected in a rotationally and positionally fixed manner to the cam disk 2 by means of connecting elements such as bolts (not shown). In addition the housing portion 13 is connected, by other connecting means such as bolts (not shown), in a rotationally and positionally fixed manner to the further housing portion 12, these bolts passing through the cam disk 2. At the bearing 11, the driveshaft 6 has a collar 14 against which the inner ring 15 of the bearing 11 rests in the axial direction. Instead of the collar 14, a retaining ring can also be used. In addition, the driveshaft 6 is held on the rotary cylinder 5 in the axial direction by a retaining ring 16. This ensures that when the radial piston engine is detached from the step-down transmission the inner ring 15, the driveshaft 6 and the rotary cylinder 5 form a structural unit. The rotary cylinder 5 also has an abutment, shown in FIG. 2, on which the rotary cylinder 5 is supported against the cam disk 2. Since the cam disk 2 and the housing portion 13 are connected and the rotary cylinder 5 is supported on the cam disk 2, for servicing purposes the radial piston engine 1 can be taken off as a complete structural unit, namely comprising the housing portion 13, distributor 10, driveshaft 6, inner ring 15, rotary cylinder 5 and cam disk 2, without having to strip down the radial piston engine 1 into its individual components.

Between the housing portion 13 and the distributor 10 are arranged springs 21, which press the distributor 10 against the rotary cylinder 5. Thus, in the disassembled condition these springs push the rotary cylinder 5 against the cam disk 2, whereby the rotary cylinder 5 remains in a fixed position relative to the cam disk 2. When the radial piston engine 1 is mounted on the further housing portion 12 again, the rotary cylinder 5 is again pushed back by the bearing 11 against the spring force of the springs 21 and the rotary cylinder 5 no longer rests against the cam disk 2 in the axial direction.

Figure 2:
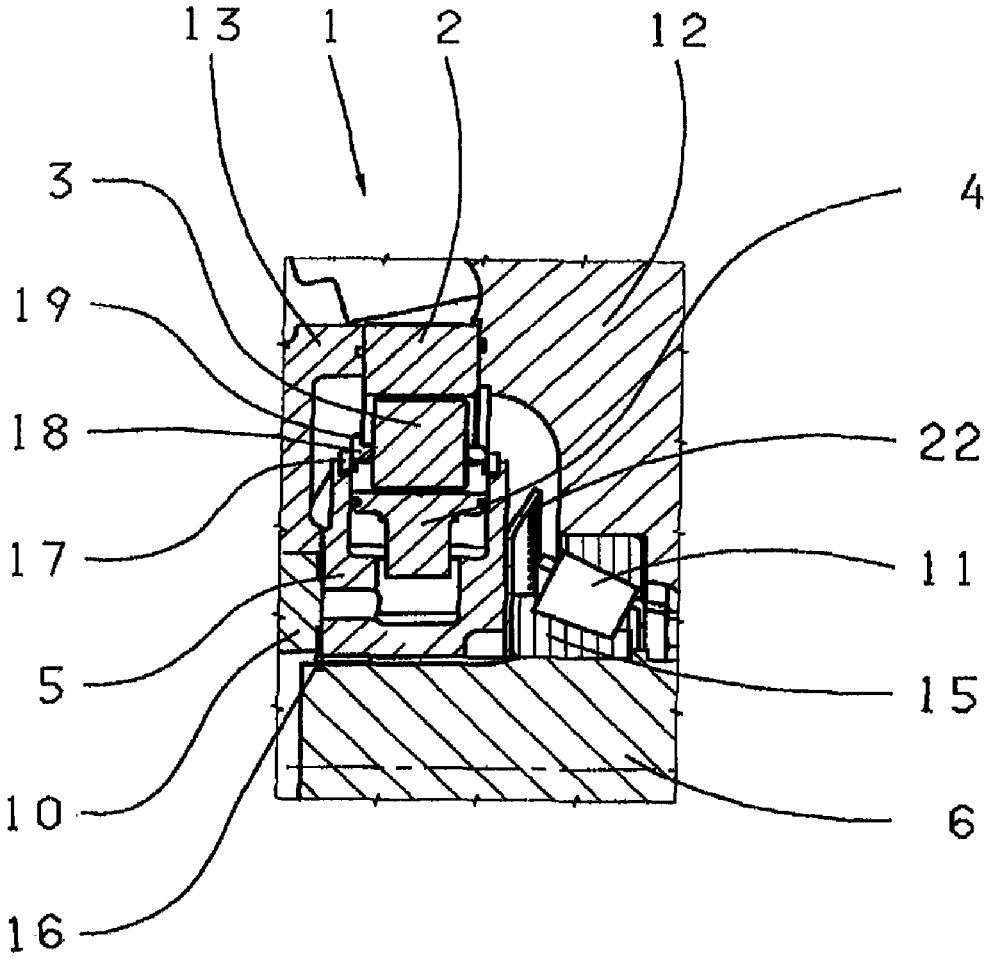

FIG. 2: The rotary cylinder 5 has a groove with a retaining ring 17, which secures a disk 18 in the axial direction. The disk 18 has a collar 19 which, in the disassembled condition of the radial piston engine 1, rests on the inner curves of the cam disk 2 and so restricts the axial movement of the rotary cylinder 5 along its rotation axis 20. Between the rotary cylinder 5 and the bearing 11 there can also be arranged a disk 22 for producing rotation speed pulses.

Figure 3:
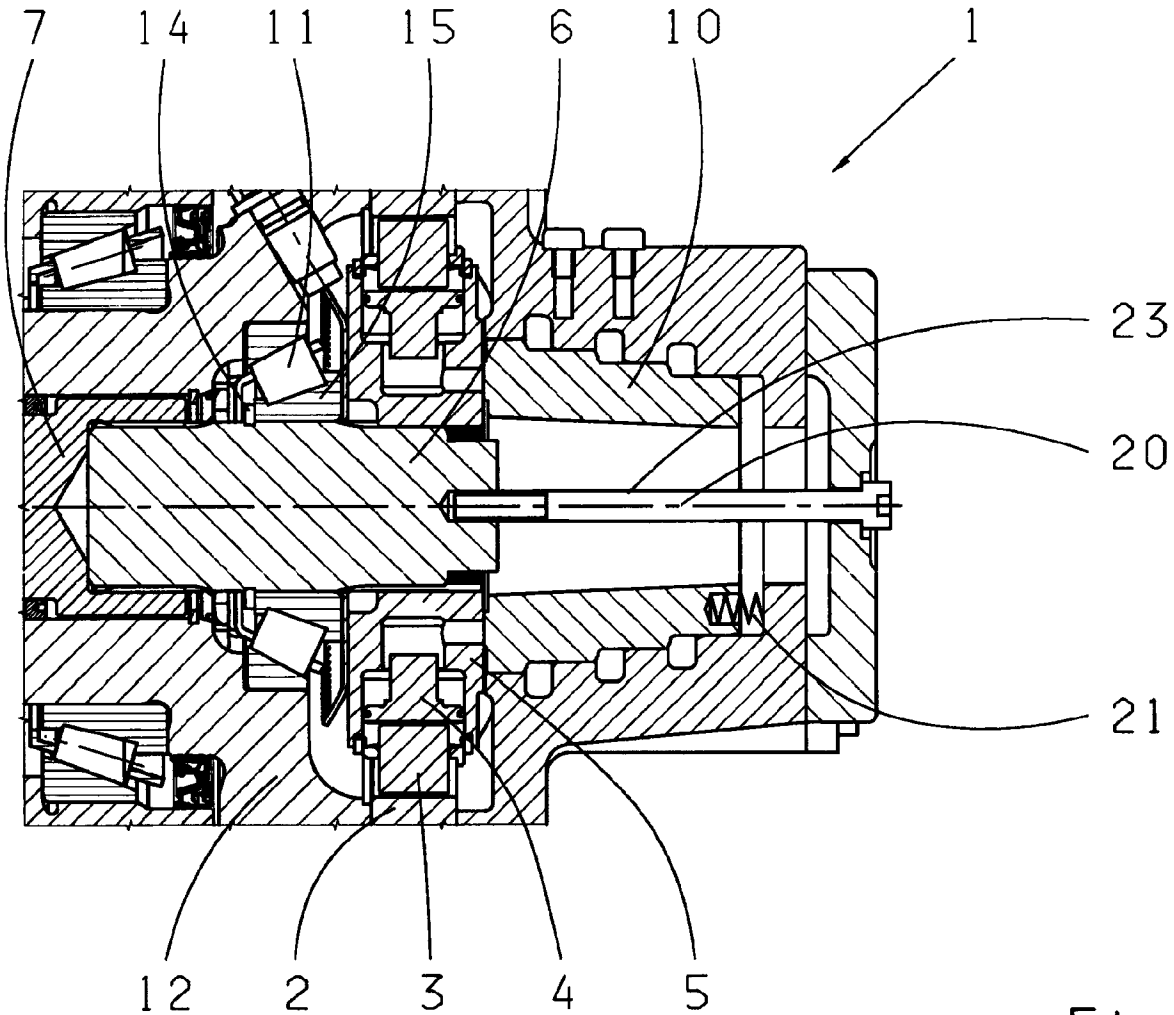

FIG. 3: The radial piston engine 1 in FIG. 3 differs from the radial piston engine 1 shown in FIG. 1, in that the rotary cylinder 5 does not rest against the cam disk 2 via a collar 19 as in FIG. 1, but instead, to take off the radial piston engine 1, a bolt 23 passes through the housing portion 13 and is screwed into the driveshaft 6. The housing portion 13 can be made as a single part or in more than one part. With its head the bolt 23 rests against the housing 13, so that the driveshaft 6 and with it the inner ring 15 and the rotary cylinder 5 are pulled in the direction of the distributor 10. Since the cam disk 2 is connected to the housing portion 13 by connecting elements, the radial piston engine 1 can be detached from the step-down transmission without having to be stripped down to its individual components. After the radial piston engine 1 has been re-installed, the bolt 23 is removed so that the springs 21 again press the rotary cylinder 5 against the bearing 11. The bolt 23 can then be used to connect the housing portion 13 to the further housing portion 12.

Figure 4:
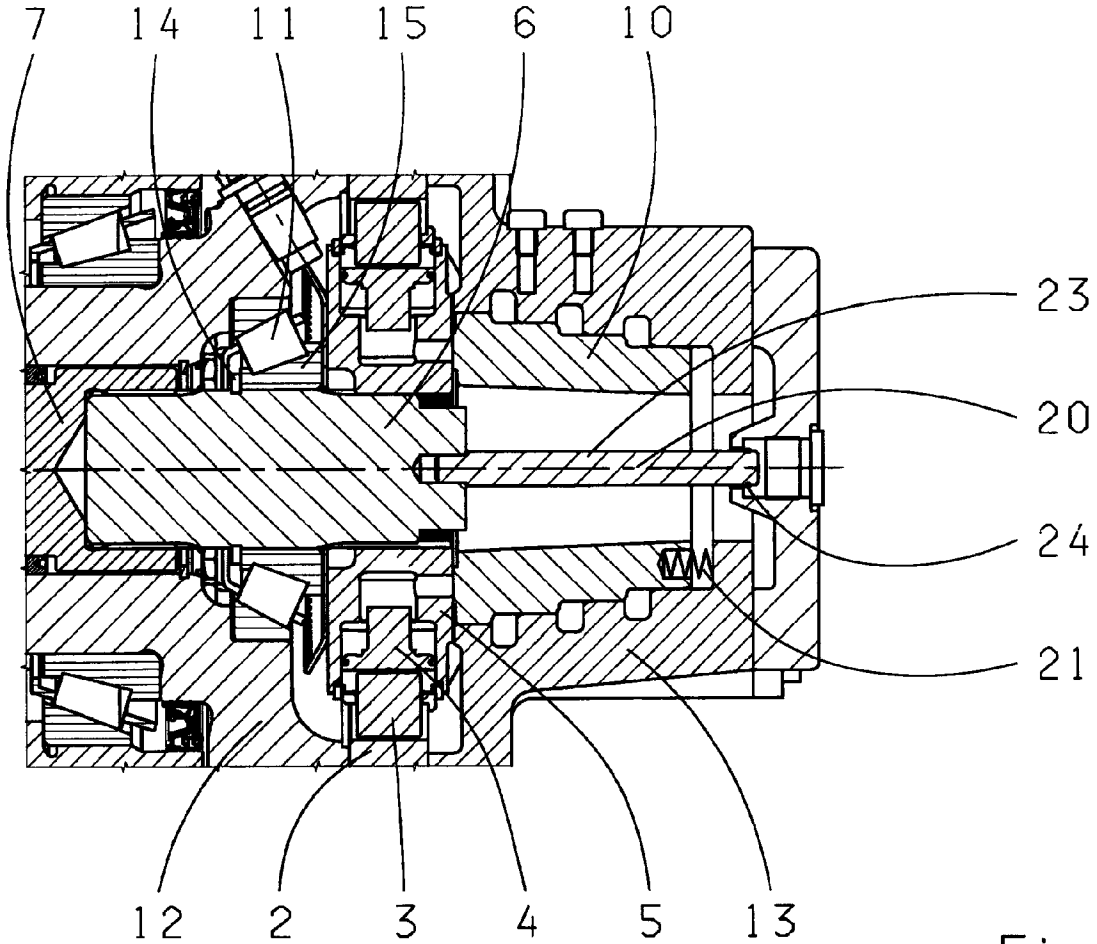

FIG. 4: The radial piston engine 1 in Fig, 4 differs from the radial piston engine 1 shown in FIG. 3, in that after the radial piston engine 1 has been mounted on the step-down transmission the bolt 23 remains in the radial piston engine 1 and rotates with it when the radial piston engine 1 is in operation. The bolt 23 can have a screw head or a retaining ring as its contact surface, or it can be made as one piece with the driveshaft 6.

Indexes

1 Radial piston engine
2 Cam disk
3 Rollers
4 Pistons
5 Rotary cylinder
6 Driveshaft
7 Sun gear
8 Planetary gears
9 Ring gear
10 Distributor
11 Bearing
12 Further housing portion
13 Housing portion
14 Collar
15 Inner ring
16 Retaining ring
17 Retaining ring
18 Disk
19 Collar
20 Rotational axis
21 Springs
22 Disk
23 Bolt
24 Retaining ring

The invention claimed is:

1. A hydraulic radial piston engine (1) with a rotary cylinder (5) that rotates about a rotational axis (20), the radial piston engine (1) comprising radially arranged pistons (4) which are actively connected with a cam disk (2), and a housing portion (13) in which a hydraulic distributor (10) is arranged, the housing portion (13) being connected in a positionally fixed manner with the cam disk (2) such that the radial piston engine (1) is connected to a further housing portion (12) to produce a structural unit, wherein, when the radial piston engine (1) is separated from the further housing portion (12), a spring force biases the rotary cylinder (5) in a direction along the rotation axis (20), from a first position to a second position, the rotary cylinder (5), in the second position, either directly or indirectly engages with the cam disk (2) so as to prevent further axial movement of the rotary cylinder (5), and when the rotary cylinder (5) is in the first position, the rotary cylinder (5) counteracts the spring force so that the rotary cylinder (5) moves axially away from engagement with the cam disk (2), the radial piston engine (1), when in the first position, is connected to the further housing portion (12) not supported on the cam disk, and the cam disk (2) is located adjacent to both the housing portion (13) and the further housing portion (12) and spaces and separates the housing portion (13) from the further housing portion (12).

2. The hydraulic radial piston engine (1) according to claim 1, wherein the rotary cylinder (5) has a groove in which a disk (18) is arranged, and the groove has a diameter such that the disk (18) is brought into at least partial contact against the cam disk (2).

3. The hydraulic radial piston engine (1) according to claim 1, wherein the distributor (10) is supported along the rotational axis (20), against the rotary cylinder (5), by a plurality of springs (21) arranged and located between between the housing portion (13) and the distributor (10).

4. The hydraulic radial piston engine (1) according to claim 1, wherein the rotary cylinder (5) is supported on a bearing (11) which, when the radial piston engine (1) is connected to the further housing portion (12), is supported on the further housing portion (12), and at least an inner ring (15) of the bearing (11) is positionally fixed, at least in the direction along the rotation axis (20), by a drive shaft (6), and the drive shaft (6) is supported, in the direction along the rotation axis (20), either indirectly or directly on the rotary cylinder (5).

5. The hydraulic radial piston engine (1) according to claim 1, wherein the rotary cylinder (5) is supported on a bearing (11) which, when the radial piston engine (1) is connected to the further housing portion (12), is supported on the further housing portion (12), and an inner ring (15) of the bearing (11) is held positionally fixed by a drive shaft (6) against the rotary cylinder (5), at least in the direction along the rotation axis (20), and the drive shaft (6) is supported, in the direction along the rotation axis (20), either indirectly or directly on the housing portion (13) with which the hydraulic distributor (10) is associated.

6. The hydraulic radial piston engine (1) according to claim 5, wherein the housing portion (13) has an opening positioned coaxially with the rotation axis (20) on which a bolt (23), connected to the driveshaft (6), is supported whereby the driveshaft (6), the bearing (11) and the rotary cylinder (5) are held in the housing portion (13).

7. The hydraulic radial piston engine (1) according to claim 6, wherein the bolt (23) is removable when the radial piston engine (1) is connected to the further housing portion (12).

8. The hydraulic radial piston engine (1) according to claim 6, wherein the drive shaft (6) drives a sun gear (7), of a planetary transmission, whose drive output is formed by a ring gear (9) which drives a concrete mixer drum.

9. The hydraulic radial piston engine (1) according to claim 1, wherein first connecting elements rotationally and fixedly connect the housing portion (13) to the cam disk (2), without connecting the housing portion (13) to the further housing portion (12).

10. The hydraulic radial piston engine (1) according to claim 9, wherein second connecting elements pass through the cam disk (2) to rotationally and fixedly connect the housing portion (13) to the further housing portion (12).

11. The hydraulic radial piston engine (1) according to claim 1, wherein the cam disk (2) forms an exterior surface of the hydraulic radial piston engine (1).

12. A hydraulic radial piston engine (1) with a rotary cylinder (5) that rotates about a rotational axis (20), the radial piston engine (1) comprising radially arranged pistons (4) which are in active connection with a cam disk (2), and a housing portion (13) in which a hydraulic distributor (10) is arranged, the housing portion (13) having a positionally fixed connection with the cam disk (2) such that the radial piston engine (1) is connected to a further housing portion (12) to produce a structural unit, wherein, when the radial piston engine (1) is in a separated condition in which the radial piston engine is separated from the further housing portion (12), a spring force biases the rotary cylinder (5), either indirectly or directly, in a direction along the rotation axis (20) on the housing portion (13) into engagement with the cam disk (2) so that the rotary cylinder (5) is retained with the housing portion (13) and when the rotary cylinder (5) is in the first position, the rotary cylinder (5) counteracts the spring force so that the rotary cylinder (5) moves axially away from engagement with the cam disk (2), and the cam disk (2) is located adjacent to both the housing portion (13) and the further housing portion (12) and spaces and separates the housing portion (13) from the further housing portion (12).

13. A hydraulic radial piston engine (1) with a rotary cylinder (5) that rotates about a rotational axis (20), the radial piston engine (1) comprising radially arranged pistons (4) which are actively connected with a cam disk (2), and a housing portion (13) in which a h draulic distributor (10) is arranged, the housing portion (13) being connected in a positionally fixed manner with the cam disk (2) such that the radial piston engine (1) is connected to a further housing portion (12) to produce a structural unit, wherein, when the radial piston engine (1) is separated from the further housing portion (12), a spring force biases the rotary cylinder (5) in a direction along the rotation axis (20), from a first position to a second position, the rotary cylinder (5), in the second position, either directly or indirectly engages with the cam disk (2) so as to prevent further axial movement of the rotary cylinder (5), and when the rotary cylinder (5) is in the first position, the rotary cylinder (5) counteracts the spring force so that the rotary cylinder (5) moves axially away from engagement with the cam disk (2), the radial piston engine (1), when in the first position, is connected to the further housing portion (12) not supported on the cam disk, and a bearing (11) and the rotary cylinder (5) are supported by a drive shaft (6), and a collar (14) and a retaining ring (16) prevent axial movement of the bearing (11) and the rotary cylinder (5) along the drive shaft (6) and thereby facilitate removal of the bearing (11), the drive shaft (6) and the rotary cylinder (5) as the structural unit.

* * * * *